United States Patent [19]

Locher

[11] 4,240,663

[45] Dec. 23, 1980

[54] ADJUSTABLE STACKING CHAIR

[75] Inventor: Hermann Locher, Pfeffingen, Switzerland

[73] Assignee: Giroflex Entwicklungs AG, Koblenz, Switzerland

[21] Appl. No.: 20,546

[22] Filed: Mar. 14, 1979

[30] Foreign Application Priority Data

Oct. 14, 1978 [DE] Fed. Rep. of Germany ... 7830726[U]

[51] Int. Cl.[2] ..... A47C 3/04; A47C 3/34

[52] U.S. Cl. ..... 297/239; 297/337; 297/440; 297/338

[58] Field of Search ..... 297/440, 335, 336, 331, 297/239, 345, 348, 337, 332, 333, 338

[56] References Cited

U.S. PATENT DOCUMENTS

| | | | |
|---|---|---|---|
| 2,627,897 | 2/1953 | Apel | 297/336 |
| 2,637,371 | 5/1953 | Boutin | 297/345 X |
| 3,118,705 | 1/1964 | Stalnacke | 297/348 |
| 3,511,533 | 5/1970 | Drabert | 297/337 |
| 3,982,785 | 9/1976 | Ambasz | 297/239 |

FOREIGN PATENT DOCUMENTS

| | | | |
|---|---|---|---|
| 1195787 | 5/1959 | France | 297/345 |
| 342710 | 1/1960 | Switzerland . | |

*Primary Examiner*—Francis K. Zugel

*Attorney, Agent, or Firm*—Weingarten, Maxham & Schurgin

[57] ABSTRACT

The chair has a hinged seat which can be pivoted into an upright position and a tubular frame with a configuration permitting stacking of chairs when the seats are upright. The upright tubular frame portions have telescoped sections on each side to permit vertical adjustment of the chair. Seat support clamps attached to the outer tube have locking pins for holding the desired vertical position. A pair of telescoped tubes are hinged to each clamp and a seat fixed to the outer ones. The inner tubes of the pairs are connected together parallel to each other by a transverse member. A turnbuckle is connected under the seat between the middle of the cross transverse member and the seat to permit forward and backward adjustment of the seat. Particular features are disclosed for the seat support clamps for making the adjustments easier.

3 Claims, 6 Drawing Figures

ADJUSTABLE STACKING CHAIR

BACKGROUND OF THE INVENTION

The present invention relates to a chair, more particularly intended for use as an orchestra chair. However, it may also be used for other purposes when approximately the same conditions exist.

The seating accomodation which has to be provided for the members of a large orchestra has to satisfy the different requirements based on the instruments to be played. Thus, for fatigue-proof sitting, the wind section of the orchestra for example requires seating accomodation which does not correspond to that most suitable for the strings section. In addition, within the latter group, due to the nature in which he plays his instrument, a cellist for example requires a different seating accomodation than a violinist.

It is an object of the invention to provide a chair which can be adapted without difficulty to these different conditions. In addition, the chair must satisfy the requirements for good stability. Since large orchestras do not always find suitable seating accomodation when on tour, it is also advantageous if they can take seats with them. Therefore, the chair must also be suitable for stacking.

SUMMARY OF THE INVENTION

The novel chair in accordance with the invention has a frame, a back and seat connected to the back, and the seat and back are together height-adjustable. In its down position the seat can be adjusted forwardly and rearwardly horizontally.

In particular due to the horizontal adjustability, individualized seating accomodation is provided with optimum adaptation to the particular activity.

DESCRIPTION OF THE PREFERRED EMBODIMENT

Figure 1:
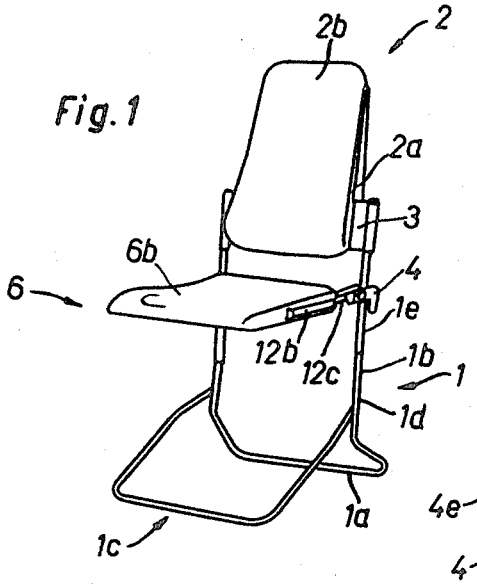
FIG. 1 is an elevated perspective view of a chair in accordance with a preferred embodiment of the present invention.
Figure 2:
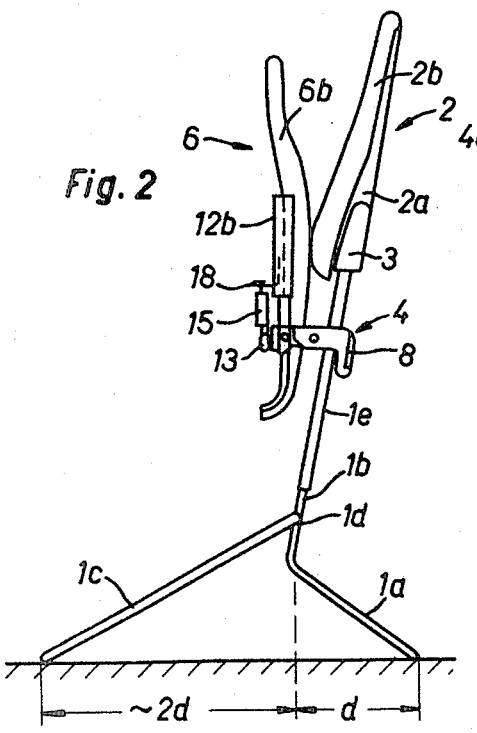
FIG. 2 is a side view of the chair of FIG. 1 with the seat in the upright position.

FIGS. 1 and 2 show a chair in accordance with a preferred embodiment of the invention. The chair comprises a tubular frame 1 which is substantially U-shaped and has a cross member 1*a* resting on the floor. The ends of two side member 1*e* receive a back 2 between holders 3 attached to them. Cross member 1*a*, together with the adjacent portions of the side members 1*b*, is bent rearwardly out of the plane of the frame (FIG. 2). A further U-shaped frame member 1*c* is provided a little above the point at which this bending out begins. Frame member 1*c* extends forwardly, and its cross member is somewhat wider than cross member 1*a*. Therefore, the ends of the frame must be bent inwardly a little (see FIG. 1) to permit a fitting to frame 1. This bending in of frame member 1*c* makes it possible to easily stack a number of chairs upon one another. If the horizontal spacing of the cross member 1*a* from the connecting point 1*d* of the two frames 1 and 1*c* is designated as dimension d (FIG. 2), then the horizontal spacing of the cross member of frame member 1*c* from the connecting point is advantageously approximately 2*d*. This leads to a good stability of the chair.

Figure 4:
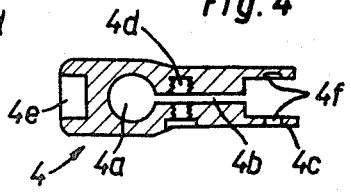
FIG. 4 is a separate sectional view of one of the supporting elements of FIG. 3 taken horizontally.

A further tube 1*e* forming a part of a height adjusting mechanism for the back 2 is mounted above the upper part of each side member 1*b*. One height adjusting mechanism is provided for each frame side member 1*b*, and each mechanism has, among other things, an approximately L-shaped casing 4, which in the cross-section as shown in FIG. 4 is constructed in a forked and slotted manner. It has a circular opening 4*a*, a longitudinal slot 4*b* emanating from the latter and two forked pronglike projections 4*c*. A not shown screw can be inserted into a first tapped hole 4*d* which passes through the slot 4*b* in the transverse direction. By means of this screw, the two prongs of the casing 4 can be drawn together, so that they firmly secure the tube 1*e* passing through the opening 4*a*. In this way, the casing 4 is fixed to the outer tube 1*e*. In the portion which runs parallel to tube 1*e*, there is a depression 4*e* and a further hole 4*f* which serves to receive a hinge pin 5, by means of which the seat 6 can be swung upward.

Figure 3:
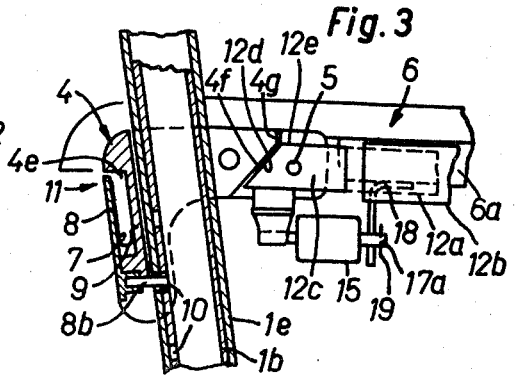
FIG. 3 is a partially sectioned view of a fragment of the chair of FIGS. 1 and 2, showing in more detail the mechanical supporting elements for the seat.
Figure 5:
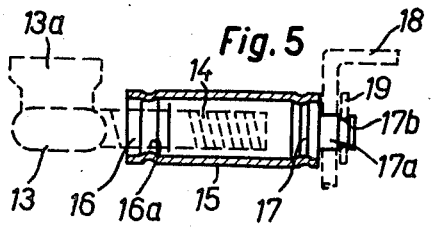
FIG. 5 is partially sectioned view of an adjusting turnbuckle of the chair of FIGS. 1 and 2.

A latch 8, which is held in the position indicated in FIGS. 2 and 3 by a leaf spring 9, is inserted in the depression 4*e* so that it pivots about an axis 7. To one end of latch 8 there is fitted a locking pin 8*b*, which is passed through holes in casing 4 and tube 1*e* and terminates in one of a plurality of adjustment holes 1*o* in tube 1*b* to fix the height position of back 2. Thus, operating of the latch 8 at the position indicated by arrow 11 rotates it about its axis 7, so that the pin 8*b* is drawn out of the hole 10. The height of back 2 can now be adjusted until pin 8*b* which, after a releasing of the latch 8, is indirectly only under the pressure of leaf spring 9, snaps into alignment with one of the holes 10. The horizontal adjustment of seat 6 is carried out by means of the device shown in FIGS. 3 and 5. For this purpose, two telescoping seat support tubes 12*a*, 12*b* are provided on each side of seat 6. The outer tube 12*b* is fitted to the seat, while the inner tube has a flat extension 12*c* which can be pivoted on the above-mentioned hinge pin 5. Extension 12*c* also has two stop faces 12*d*, 12*e* cooperating with corresponding surfaces 4*f*, 4*g* of the casing in the horizontal and/or vertical position of seat 6.

Figure 6:
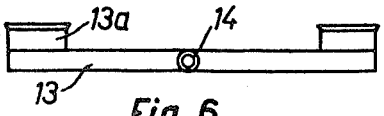
FIG. 6 is a separate end view of another supporting element of the chair of FIGS. 1 and 2.

The two extensions 12*c* are interconnected by a transverse cross-piece 13 (FIG. 6), which is preferably in the form of a flat oval tube. To the ends thereof are fitted spacers 13*a*, 13*b* permitting the fixing thereof to the extension. In the centre thereof is provided a horizontal threaded spindle 14 located in the vertical median plane of the chair. The spindle 14 cooperates with an adjusting turnbuckle 15. The latter is essentially a tube having at its one end a first disk 16 with a tapped hole 16*a* and at its other end a second disk 17 with a swivel pivot 17*a*, provided with an annular groove 17*b*. These two disks are placed in the tube and then crimped in place. An angle plate 18 is mounted on pivot 17*a* so as to be rotatable relative to the latter, but non-displaceable axially. Relative axial displacement of the angle plate 18 is prevented by a snap-ring seated in the annular groove 17*b*.

As can be gathered from FIG. 3, angle plate 18 is rigidly connected to the bottom of the shell-shaped portion 6*a* of the seat. If the turnbuckle 15 is now rotated manually, and to this end its outer face is knurled, it moves axially on threaded spindle 14 and draws the angle plate 18 with it, so that the seat is axially adjusted on the tubes 12*a*.

Both seat 6 and back 2 can be provided with a cushion 6*b* or 2*b* secured in an appropriate manner to the shell-shaped portion 6*a* or the shell-shaped portion 2*a* of the back. Advantageously, the two shell-shaped portions are extruded plastic.

I claim:

1. A chair, comprising:

a frame;

a backrest fixed to said frame;

a pair of casings adjustable vertically on said frame and adapted to adjust the vertical height of said backrest and to be locked into position at a desired vertical height on said frame;

a pair of substantially parallel first seat support tubes, each of said first seat support tubes extending forwardly from one of said casings and being pivotally secured to said one of said casings by a hinge pin, said pair of first seat support tubes being adapted to be pivoted into a vertical position about said hinge pins;

a transverse member rigidly interconnecting said pair of first seat support tubes;

a seat disposed on said first seat support tubes and adapted to be moved in an axial direction along said pair of first seat support tubes; and linear displacement means connected to said seat and disposed beneath said seat between said seat and said transverse member and adapted for axial adjustment of said seat.

2. The chair of claim 1 wherein said linear displacement means comprises a turnbuckle and a swivel connecting said turnbuckle to said seat.

3. The chair of claim 1 comprising a pair of second seat support tubes, each of said second seat support tubes being slidably telescoped over one of said first seat support tubes, said seat being attached to said second seat support tubes.

* * * * *

UNITED STATES PATENT AND TRADEMARK OFFICE

CERTIFICATE OF CORRECTION

PATENT NO. : 4,240,663

DATED : December 23, 1980

INVENTOR(S) : Hermann Locher

It is certified that error appears in the above—identified patent and that said Letters Patent is hereby corrected as shown below:

Column 3, line 11, "Advantageously," should read --Preferably,--.

Signed and Sealed this

*Twenty-fourth* Day of *November 1981*

[SEAL]

*Attest:*

GERALD J. MOSSINGHOFF

*Attesting Officer*

*Commissioner of Patents and Trademarks*